US005193277A

United States Patent [19]

Zmijewski

[11] Patent Number: 5,193,277

[45] Date of Patent: Mar. 16, 1993

[54] SCISSORS GUN

[76] Inventor: Harry H. Zmijewski, 5471 Beaver Dr., Mableton, Ga. 30059

[21] Appl. No.: 813,450

[22] Filed: Dec. 26, 1991

[51] Int. Cl.[5] ..... B26B 13/00

[52] U.S. Cl. ..... 30/261; 30/254; 30/257

[58] Field of Search ..... 30/249, 250, 254, 258, 30/259, 257, 261, 262

[56] References Cited

U.S. PATENT DOCUMENTS

| | | | |
|---|---|---|---|
| 1,104,768 | 7/1914 | Bernard | 30/262 X |
| 2,852,846 | 9/1958 | Ahlbin | 30/257 X |
| 2,861,038 | 1/1975 | Charles et al. | 30/261 |

*Primary Examiner*—Douglas D. Watts

*Attorney, Agent, or Firm*—Hodgson, Russ, Andrews, Woods & Goodyear

[57] ABSTRACT

A scissors gun having a handle, a movable blade pivotally interconnected with a stationary blade which is joined to the handle, and an elastic member compressibly interposed between the rear end portions of the stationary blade and the movable blade so that the cutting edge portions of said blades are biased in the open position. The rear end portion of the movable blade has a trigger which, when squeezed toward the handle, compresses the elastic member causing the blades to come together, thus, activating the cutting action of the scissors.

7 Claims, 2 Drawing Sheets

Fig. 2.
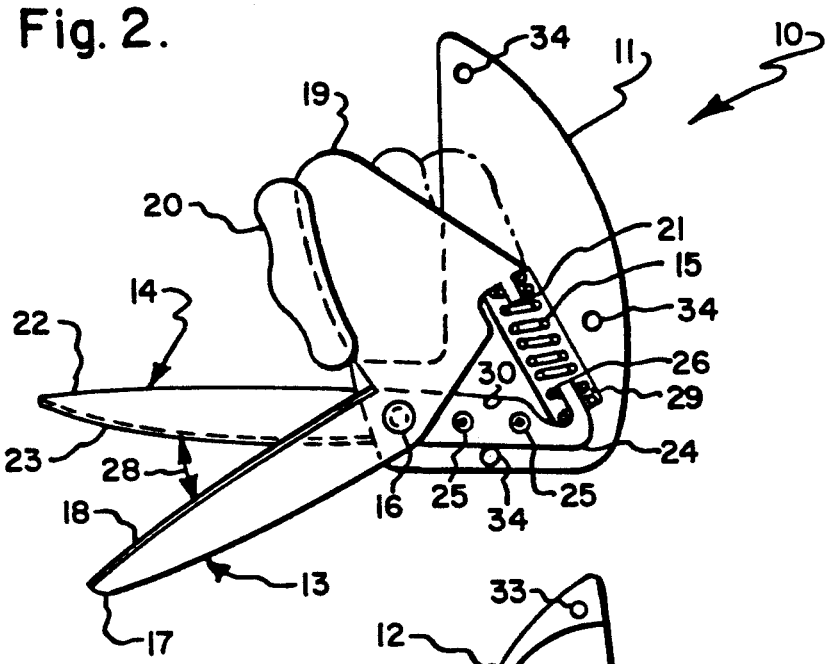
Fig. 3.
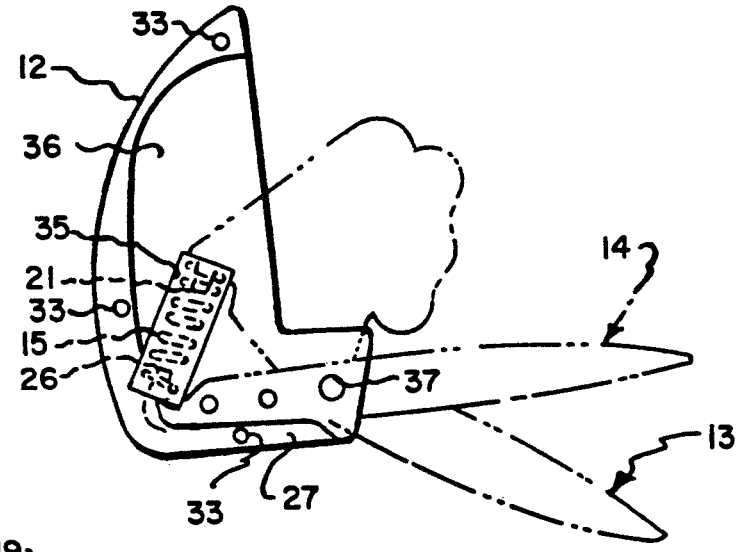
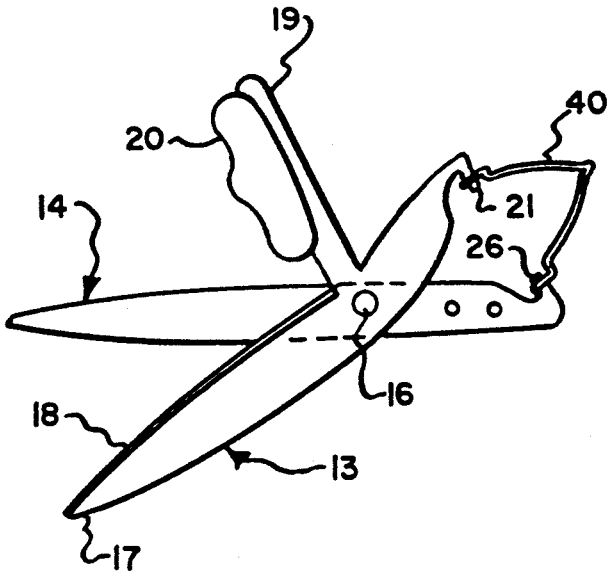
Fig. 4.

SCISSORS GUN

BACKGROUND OF THE INVENTION

Field of Invention

Scissors-type cutting device.

The cutting action of standard scissors requires specific movements of the thumb and one or more fingers. The standard scissors referred to herein are those scissors that have loops at the handle end portion for engaging the thumb and one or more fingers. The cutting blades of standard scissors, which are on the opposite ends of the finger and thumb engaging loops, are activated for cutting by the movement of the thumb and finger(s) which move the blades alternately together and apart around a pivot point at which the blades are movably connected.

This cutting action of standard scissors requires the operator to squeeze the loops together with the finger(s) and thumb in their respective loops and then to contract the muscles of the finger(s) and thumb to reopen the blades. Specific gross motor skills are required for operating such standard scissors. Additionally, the operator must have fingers and a thumb capable of the required movements.

People with physical defects of either the fingers or the thumb and people with neurological disorders adversely affecting their ability to perform the required gross motor movements find it awkward, inconvenient, or impossible to use standard scissors. This includes, but is not limited to, those persons handicapped by cerebral palsy, radial club hand deficiency, arthritis, stroke, spinal meningitis, and by physical injury. Thus, a substantial number of people are unable to use standard scissors.

In addition to being unusable by a significant number of handicapped persons, standard scissors have other shortcomings. For example, it is difficult and cumbersome to use standard scissors to cut stiff materials. When used to cut a stiff material, it is necessary to bend the material to permit not only the scissors but also the hand operating the scissors to pass through the material as it is being cut.

Additionally, the use of standard scissors generally requires the user to hold the hand at an right angle relative to the wrist. This is a less comfortable position than having the hand in its natural position in a straight line from the wrist. Scissors which could be used with the hand in its natural position extending in a straight line from the wrist would be more comfortable and easier to use for all users and especially users having handicaps as discussed above.

Finally, standard scissors generally are made with the finger engaging loop or both finger and thumb engaging loops having surfaces that are inclined at an angle to accommodate only right-handed persons. While scissors having loops with surfaces inclined to accommodate left-handed persons are available, they are not as widely available as right-handed scissors.

Despite the limitations of standard scissors, few alternatives are available. One alternative is disclosed in U.S. Pat. No. 4,663,848 to Sell. In Sell, the finger and thumb engaging loops of the standard scissors are replaced with a ball-shaped elastic member and a spring mechanism that biases the blades toward the open position. When the ball-shaped member is squeezed, the scissor blades are pushed together for cutting. The spring mechanism returns the blades to the open position.

The device disclosed in Sell requires a complex construction for the scissors handle and also requires certain motor movements and dexterity for holding and squeezing the ball. Furthermore, the device disclosed in Sell, like standard scissors, requires the user to hold the hand at an angle relative to the wrist. Finally, the devise disclosed in Sell does not solve the problems associated with using scissors to cut stiff materials. Accordingly, the device disclosed in Sell does not solve all of the significant shortcomings associated with standard scissors leaving considerable room for improvement in the construction of scissors.

SUMMARY OF THE INVENTION

The present invention comprises a scissors gun having a stationary blade joined to a handle at its rear end portion and a movable blade having a trigger at its rear end portion. The two blades are pivotally interconnected and are biased in the open position by an elastic member compressibly interposed between the rear end portions of the two blades. The scissor blades are at approximately a right angle to the handle so that when used, the user's hand is in its natural position approximately in a straight line with the wrist.

The scissors gun of the present invention is operated by placing the handle in the palm of the hand and squeezing the trigger with the fingers. When cutting stiff materials, only the handle portion housing the stationary blade need move through the material since the hand, being at approximately a right angle to the blades, does not move through the cutting path of the blades.

It is an object of the present invention to provide a scissors gun which can be used by people having handicaps affecting the motor skills required for using standard scissors as well as by people having physical impairments that inhibit the use of standard scissors.

It is a further object of the present invention to provide a scissors gun that can be used with the hand in approximately a straight line with respect to the wrist so that the scissors gun can be used more comfortably than standard scissors by all people.

Another object of the present invention is to provide a scissors gun which can be used with equal comfort by both left handed and right handed persons.

Another object of the present invention is to provide a scissors gun which can be used more easily than standard scissors for cutting stiff materials.

These and other objects of the present invention will become apparent to one skilled in the art from the drawings and the detailed description that follows.

BRIEF DESCRIPTION OF THE DRAWINGS

FIG. 2 is a side view of one embodiment of the apparatus of the invention with the handle cover removed and showing the inside surface of the handle part to which the stationary blade is joined.

FIG. 3 is a side view of one embodiment of the handle cover of the apparatus of the present invention showing the inside surface of the handle cover with the scissor blades, trigger and elastic member shown in phantom.

FIG. 4 is a side view of the scissor blades of the apparatus of the present invention showing alternative embodiments for the movable blade and the elastic member.

DETAILED DESCRIPTION OF THE PREFERRED EMBODIMENTS

Figure 1:
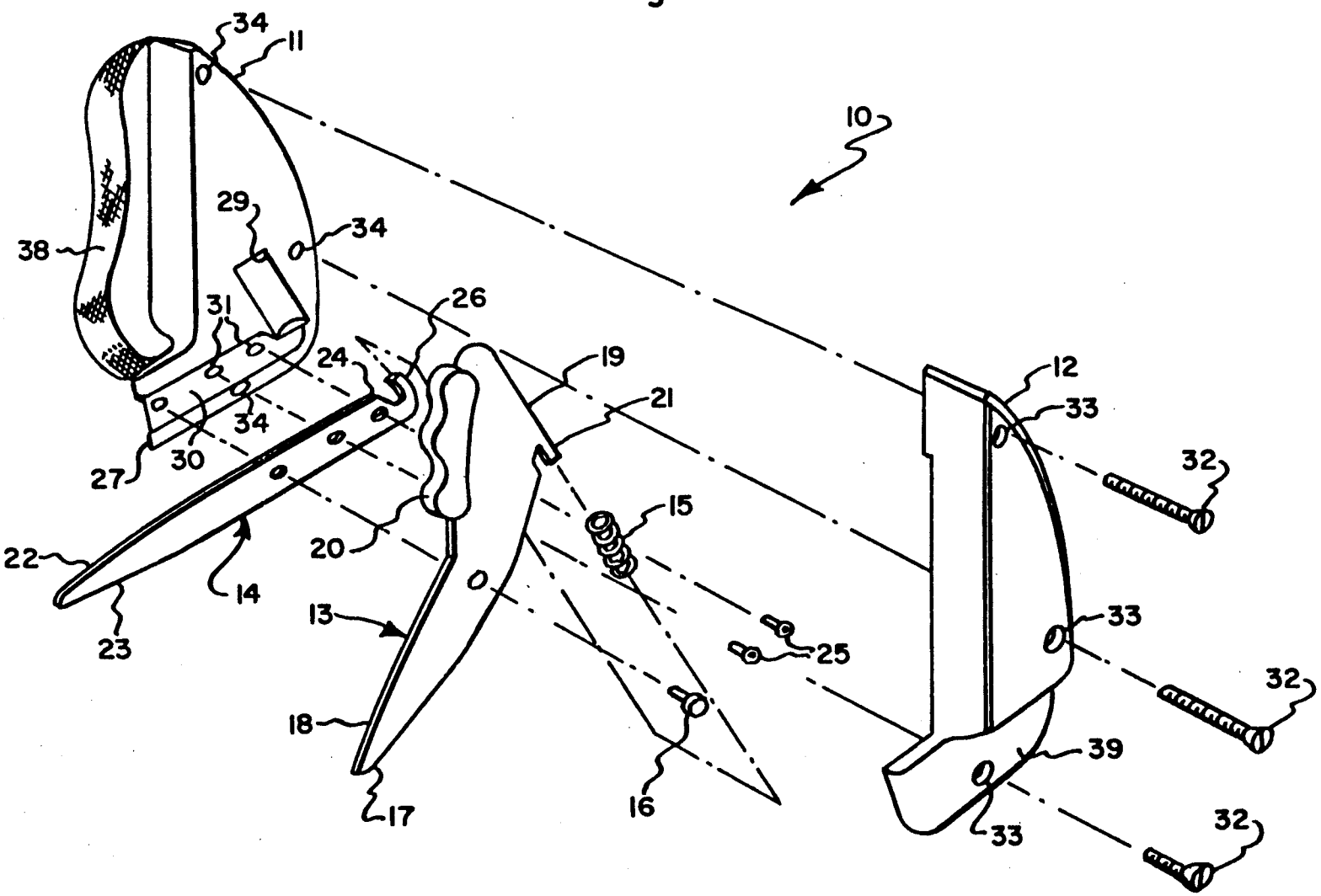
FIG. 1 is an exploded view of one embodiment of the apparatus of the invention.

The preferred embodiments of the invention are described with reference to FIGS. 1 through 3, wherein like numbers represent like parts throughout the views.

As shown in FIG. 1, scissor gun 10 is comprised of handle part 11, handle cover 12, movable blade 13, stationary blade 14, and an elastic member such as compression spring 15. Movable blade 13 and stationary blade 14 are pivotally interconnected, for example, by pivot pin 16, or by a pivot screw (not shown). Movable blade 13 has forward end portion 17 which has a cutting edge portion 18. Movable blade 13 also has rear end portion 19 which has trigger 20 and tab 21 for engaging compression spring 15.

Stationary blade 14 has forward end portion 22, which has cutting edge portion 23, and rear end portion 24, which is joined to handle part 11, for example, by set screws 25. Rear end portion 24 has tab 26 for engaging compression spring 15. Raised portion 27 of handle part 11, as shown in FIG. 1, and the corresponding raised portion 27 of handle cover 12, as shown in FIG. 3, meet when the handle is fully assembled and prevent movable blade 13 from opening any more than predetermined angle 28, shown in FIG. 2, between cutting edge portions 18 and 23.

Compression spring 15 is compressibly interposed between rear end portion 19 of movable blade 13 and rear end portion 24 of stationary blade 14 so that forward end portions 17 and 22 are biased in the open position. Compression spring 15, as shown in FIGS. 1 and 2, engages the rear end portions 19 and 24 at tabs 21 and 26 respectively.

As shown in FIG. 1, handle part 11 has recessed area 29 for receiving the elastic member, such as compression spring 15. Recessed area 29 is recessed approximately one-half of the outside diameter of the elastic member such as compression spring 15. Handle part 11 also has recessed area 30 for receiving rear end portion 24 of stationary blade 14. Rear end portion 24 of stationary blade 14 is joined to handle part 11 by any known fastening means such as set screws 25 which engage handle part 11 at set screw receiving holes 31.

As shown in FIG. 1, handle cover 12 mates with handle part 11 and is connected to handle part 11 by any conventional means such as screws 32 which go through handle cover 12 at screw holes 33 and engage handle part 11 at screw receiving holes 34. As shown in FIG. 3, handle cover 12 has recessed area 35 for receiving compression spring 15 and recessed area 36 for receiving rear end portion 19 of movable blade 13. Recessed area 36 is large enough to accommodate rear end portion 19 for all positions of movable blade 13. As shown in FIG. 3, handle cover 12 has recessed area 37 for receiving the protruding portion of pivot pin 16.

As shown in FIG. 1, handle part 11 may have a flexible strap 38 through which the hand may fit to help keep the scissors gun in place to make it easier to use by handicapped persons. Strap 38 may be made of any flexible material such as leather, cloth or plastic. Strap 38 may be removable.

Rear end portion 19 of movable blade 13 may take any shape that permits the trigger action movement described above. For example, rear end portion 19 may have a V-shape with the point of the "V" pointing generally in the direction of pivot pin 22, as shown in FIG. 4.

The elastic member, which is depicted in the drawings as compression spring 15, may be comprised of any elastic element. For example, the elastic member may be comprised of a molded plastic or metal part, generally V-shaped, such as elastic element 40 shown in FIG. 4, which may be compressed but which returns to its original position when the compression force is removed. The handle would be correspondingly modified to accommodate the shape of such an elastic element.

The handle may have a narrow portion such as narrow portion 39 shown in FIG. 1, on that part of the handle that is in the cutting path of the blades. Narrow portion 39 permits the handle more easily to go through the material being cut making it easier to cut stiff materials.

The handle, which is depicted in FIG. 1 as being comprised of two mateable handle components (handle part 11 and handle cover 12) may take on any embodiment that falls within the scope of the present invention. For example, the handle may be comprised of two molded mateable plastic or metal parts at least one having a raised rim at its edges to create a hollow interior space sufficient to accommodate the elastic member and the rear end portions of the blades, thus, eliminating the need for specific recessed areas such as recessed area 35 shown in FIG. 3. Such a molded handle may be made in a fanciful shape, such as the shape of an animal, for use by young children.

Additionally, the handle may be made of molded metal in which case handle part 11 and stationary blade 14 may be a single molded part having a raised tab for engaging the elastic member. A semicircular molded area may be molded into this handle-blade combination to accommodate the elastic member so as to eliminate the need for a mateable handle cover.

The embodiments described above are not limiting. It will be understood that variations and modifications can be effected within the spirit and scope of the invention as described above and as defined by the claims that follow.

I claim:

1. Scissors comprising:

a. a handle comprising a solid body;

b. a stationary blade and a movable blade, said blades being pivotally interconnected and each of said blades having a forward end portion and a rear end portion;

c. the stationary blade and the movable blade each having a cutting edge portion at the forward end portion of each blade;

d. the rear end portion of the stationary blade joined to the handle and said handle extending substantially a right angle with respect to said stationary blade;

e. the rear end portion of the movable blade having a trigger comprising a solid body shaped for squeezing by the fingers of the user; and f. an elastic member compressibly interposed between the rear end portion of the stationary blade and the rear end portion of the movable blade biasing the forward end of the movable blade in an open position;

g. so that said scissors is operated by placing said handle in the palm of the hand of the user and squeezing said trigger with the fingers of the user so that the user's hand is in its natural position approximately in a straight line with the wrist.

2. The scissors as recited in claim 1, wherein the handle is further comprised of two mateable parts.

3. The scissors as recited in claim 1, wherein said elastic member is comprised of a compression spring.

4. The scissors as recited in claim 1, wherein said elastic member is comprised of a flexible material having a V-shape and having the property of returning to its original shape after removal of any force that changes its original shape.

5. The scissors as recited in claim 1, wherein the rear end portion of the stationary blade and the elastic member are encased within the handle.

6. The scissors as recited in claim 1, further comprising a strap joined to the handle.

7. Scissors comprising:

a. a handle;

b. a stationary blade and a movable blade, said blades being pivotally interconnected and each of said blades having a forward end portion and a rear end portion;

c. the stationary blade and the movable blade each having a cutting edge portion at the forward end portion of each blade;

d. the rear end portion of the stationary blade joined to the handle;

e. the rear end portion of the movable blade having a trigger;

f. an elastic member compressibly interposed between the rear end portion of the stationary blade and the rear end portion of the movable blade biasing the foreward end of the movable blade in an open position; and g. said handle having a portion that is within the cutting path of the blades, said portion being narrower than the remainder of said blade handle.

* * * * *